US010851528B2

(12) United States Patent
Wang et al.

(10) Patent No.: US 10,851,528 B2
(45) Date of Patent: Dec. 1, 2020

(54) LIFTABLE AND ADJUSTABLE SHOWER DEVICE

(71) Applicant: Runner (Xiamen) Corp., Xiamen (CN)

(72) Inventors: Qing-Ping Wang, Xiamen (CN); Jin-Teng Liu, Xiamen (CN); Zhi-Sheng Li, Xiamen (CN)

(73) Assignee: RUNNER (XIAMEN) CORP., Xiamen (CN)

( * ) Notice: Subject to any disclaimer, the term of this patent is extended or adjusted under 35 U.S.C. 154(b) by 0 days.

(21) Appl. No.: 16/406,584

(22) Filed: May 8, 2019

(65) Prior Publication Data

US 2019/0390448 A1 Dec. 26, 2019

(30) Foreign Application Priority Data

Jun. 22, 2018 (CN) ..... 2018 1 0652721

(51) Int. Cl.

| | |
|---|---|
| ***E03C 1/06*** | (2006.01) |
| ***B05B 15/628*** | (2018.01) |
| ***B05B 1/18*** | (2006.01) |

(52) U.S. Cl.

CPC ..... *E03C 1/066* (2013.01); *B05B 1/185* (2013.01); *B05B 15/628* (2018.02)

(58) Field of Classification Search

CPC ..... B05B 15/628; B05B 1/185; E03C 1/066
See application file for complete search history.

(56) References Cited

U.S. PATENT DOCUMENTS

| | | | | | |
|---|---|---|---|---|---|
| 1,054,572 | A * | 2/1913 | Langley | E03C 1/06 | 4/567 |
| 1,360,381 | A * | 11/1920 | Edwards | E03C 1/06 | 285/61 |
| 1,724,147 | A * | 8/1929 | Russell | E03C 1/06 | 239/283 |
| 1,758,115 | A * | 5/1930 | Kelly | A47K 3/28 | 239/282 |
| 3,121,235 | A * | 2/1964 | Gellmann | A47K 3/285 | 4/570 |
| 5,833,192 | A * | 11/1998 | Buhrman | E03C 1/06 | 248/295.11 |
| 6,045,284 | A * | 4/2000 | Chiu | A46B 11/063 | 15/144.4 |
| 6,322,006 | B1 * | 11/2001 | Guo | B05B 15/628 | 239/532 |
| 8,230,882 | B2 * | 7/2012 | Lacher | E03C 1/0404 | 137/801 |
| 2005/0116062 | A1 * | 6/2005 | Yang | E03C 1/06 | 239/283 |
| 2016/0207063 | A1 * | 7/2016 | Mao | B05B 15/628 | |
| 2017/0314240 | A1 * | 11/2017 | Culmer | E03C 1/0408 | |
| 2019/0211537 | A1 * | 7/2019 | Lee | E03C 1/025 | |
| 2019/0345700 | A1 * | 11/2019 | Davidson | E03C 1/025 | |

* cited by examiner

*Primary Examiner* — Janie M Loeppke
(74) *Attorney, Agent, or Firm* — Chun-Ming Shih; HDLS IPR Services

(57) ABSTRACT

A liftable and adjustable shower device, that includes: an outer tube, an inner tube, an upper fixing seat, and a liftable tube. The outer tube is disposed in the shower device; and the inner tube is disposed in the outer tube. The upper fixing seat is disposed around an upper end of the outer tube. The liftable tube is sleeved around the inner tube, the liftable tube is insertable from an upper end of the upper fixing seat, to sleeve around outside the outer tube.

6 Claims, 7 Drawing Sheets

LIFTABLE AND ADJUSTABLE SHOWER DEVICE

BACKGROUND OF THE INVENTION

Field of the Invention

The present invention relates to a shower device, and in particular to a liftable and adjustable shower device.

The Prior Arts

Nowadays, more and more shower devices are utilized in our daily life. However, the shortcoming is that, presently, the water inlet column for the shower device can be fixed at a certain height only and can not be adjusted. As such, the height of the Top Spry for the shower can not be adjusted as required, therefore it is overly high or not high enough, to cause inconvenience to the user. Alternatively, the water inlet column can be made into two different Specifications, and that requires two kinds of packagings for the user to choose, while they can only provide two different heights. In addition, a straight tube can be provided, that could cause additional cost, and in case the user decides not to use the straight tube, the straight tube is wasted. Therefore, there is an urgent need in this field to provide a shower device, for which a liftable tube can be adjusted upward or downward, to achieve the height of the Top Spray as required by the user.

Therefore, presently, the design and performance of the shower device is not quite satisfactory, and it leaves much room for improvements.

SUMMARY OF THE INVENTION

In view of the problems and drawbacks of the prior art, the present invention provides a liftable and adjustable shower device, to overcome the deficiency of the existing technology.

The present invention provides a liftable and adjustable shower device, that includes: an outer tube, an inner tube, an upper fixing seat, and a liftable tube. The outer tube is disposed in the shower device; and the inner tube is disposed in the outer tube. The upper fixing seat is disposed around an upper end of the outer tube. The liftable tube is sleeved around the inner tube, the liftable tube is insertable from an upper end of the upper fixing seat, to sleeve around outside the outer tube.

In an aspect of the present invention, in the upper fixing seat is disposed a connection ring sleeving around an outer perimeter of the liftable tube. In the outer tube and around an outer perimeter of the liftable tube is disposed a stop block, acting in cooperation with a lower end of the connection ring. A press tight nut is disposed on the upper end of the upper fixing seat, acting in cooperation with the upper end of the upper fixing seat. A first slant face is disposed at a lower end of the press tight nut, and the connection ring is a C shape ring. At an upper end of the connection ring is disposed a second slant face acting in cooperation with the first slant face. In the upper fixing seat is disposed a third slant face, and at a lower end of the connection ring is disposed a fourth slant face acting in cooperation with the third slant face.

In another aspect of the present invention, the liftable tube 40 includes a bend tube and a connector located at a water inlet end of the bend tube. One end of the connector can be inserted into the bend tube, while the other end of the connector is disposed a ring shape slot. A fastening ring is placed in and around the ring shape slot, and the stop block is disposed at an outer perimeter of the fastening ring.

In yet another aspect of the present invention, at an upper end and a lower end and around the outer perimeter of the fastening ring are disposed the stop blocks forming into a ring.

In a further aspect of the present invention, a water inlet tube is disposed on the upper fixing seat, and a water inlet channel is disposed between an inner perimeter of the outer tube and an outer perimeter of the inner tube. The water inlet channel is connected to the water inlet tube. A lower fixing seat is disposed at a lower end of the outer tube. In the lower fixing seat is disposed a switching valve connected to and in communication with the water inlet channel. On the lower fixing seat is disposed a water outlet tube acting in cooperation with the switching valve, and the switching valve is in contact with an inner perimeter of the inner tube.

In another aspect of the present invention, in the water inlet tube is disposed a water inlet connector in contact with the water inlet tube. At least two step faces are disposed in the water inlet tube and around an outer perimeter of the water inlet connector. A through hole is disposed on a side wall of the water inlet tube, and on the though hole is disposed a lock tight screw acting in cooperation with the at least two step faces.

In yet another aspect of the present invention, a fixing ring is fixed onto a wall around the outer perimeter of the inner tube. A plurality of connection plates are disposed on a wall around an outer perimeter of the fixing ring, to act in cooperation with a wall around the inner perimeter of the outer tube.

Compared with the existing technology, the liftable and adjustable shower device of the present invention has the following advantages: 1. It solves the previous problem that the height of Top Spray on the shower column can not be adjusted, to facilitate user taking a shower. 2. It solves the problem that user has to take the trouble to choose among different Specifications of shower devices. 3. It could save an additional tube piece to reduce production cost, and facilitate installation of the shower device for the user.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

In the following, an embodiment is used to describe the various details of the present invention. However, it does not mean that this embodiment represents all the embodiments of the present invention. Other embodiments can be envisaged by people familiar with this field, and thus they all fall into the scope of the present invention.

Figure 1:
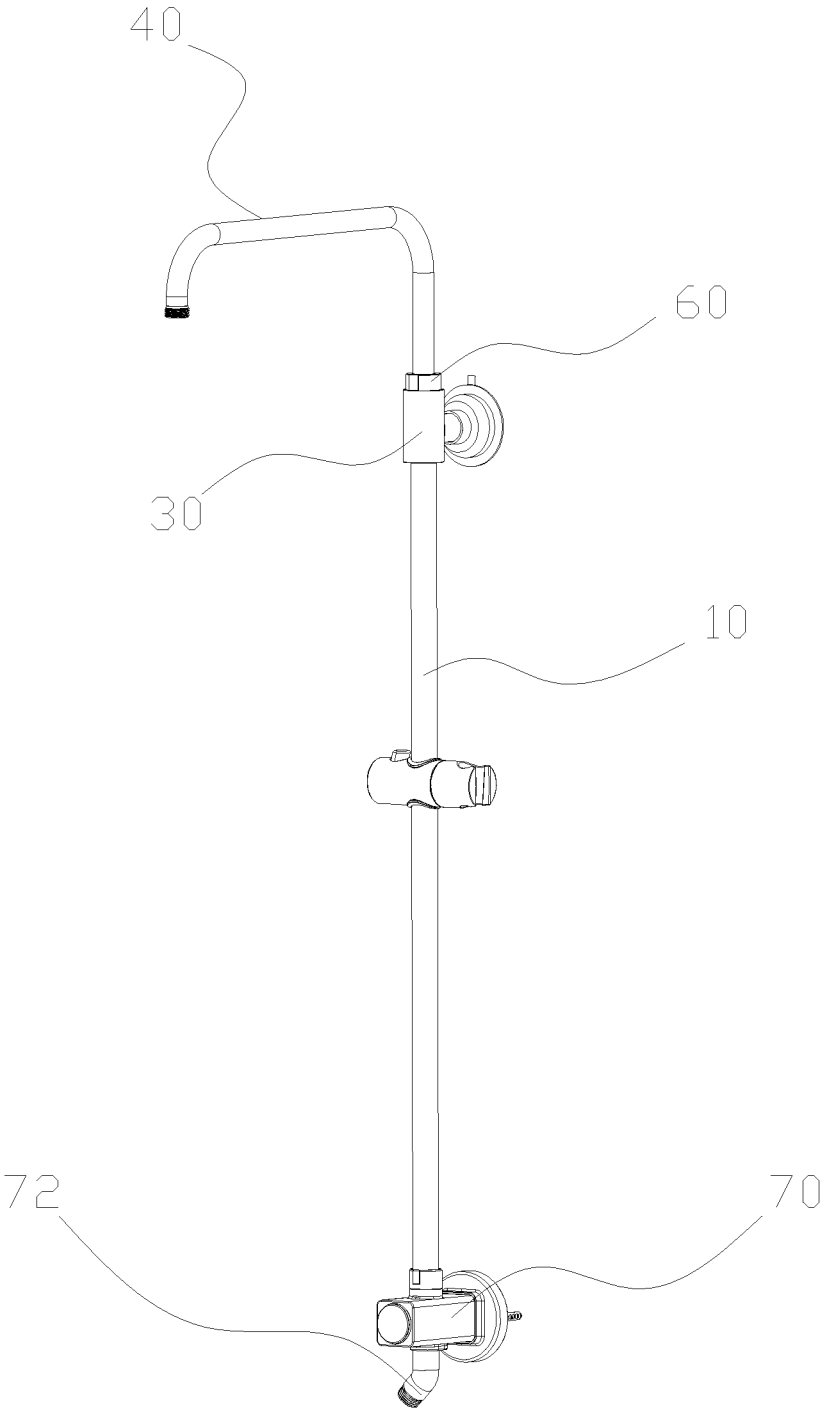
FIG. 1 is a schematic diagram of a liftable and adjustable shower device according to the present invention.
Figure 2:
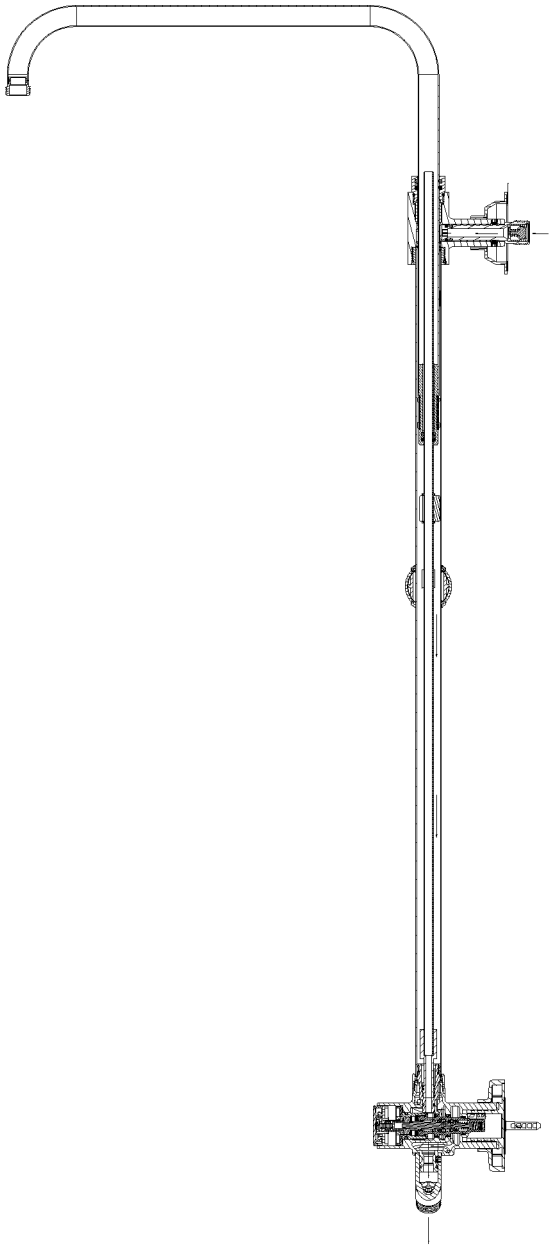
FIG. 2 is schematic diagram of a liftable and adjustable shower device in an adjusted condition according to the present invention.
Figure 3:
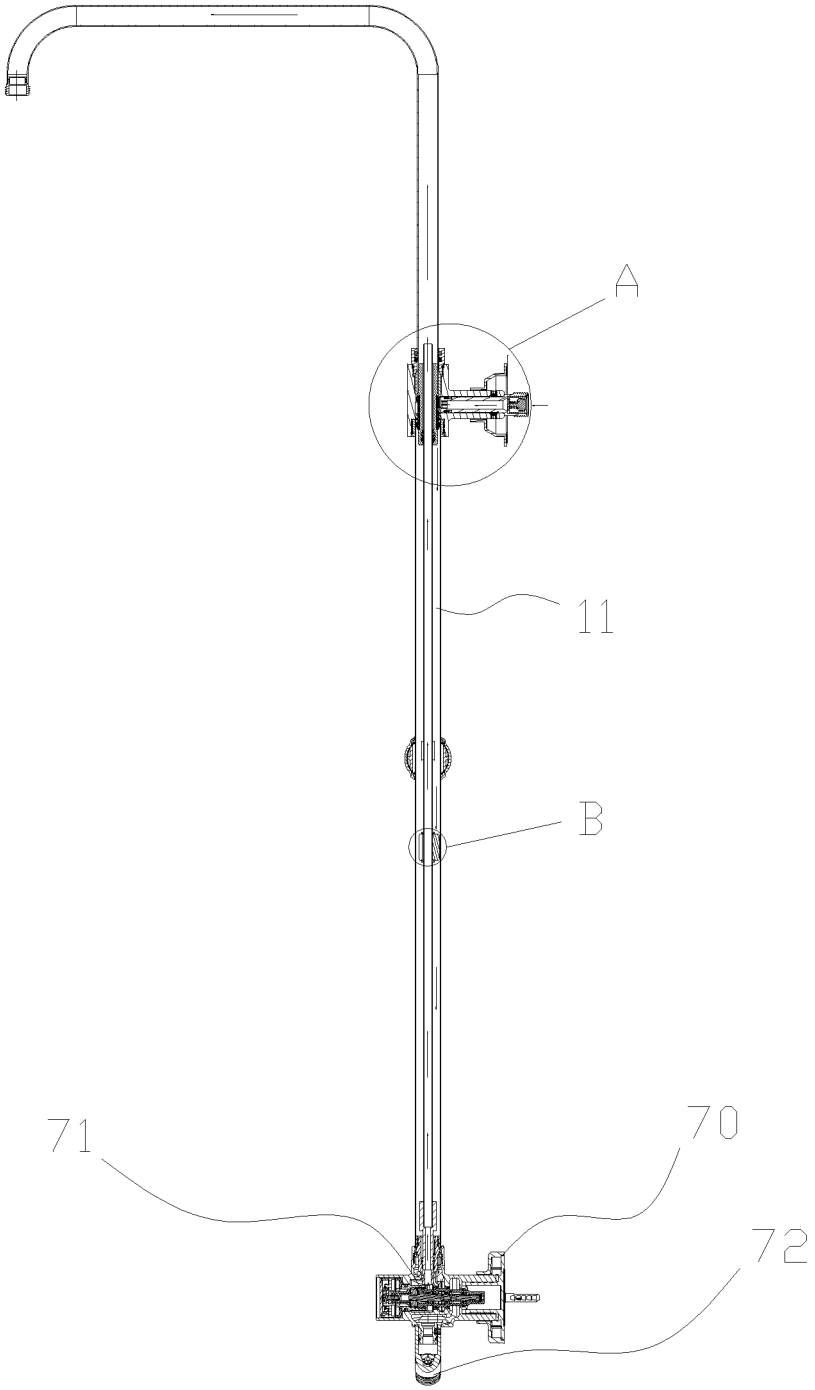
FIG. 3 is a schematic diagram of a liftable and adjustable shower device in another adjusted condition according to the present invention.
Figure 4:
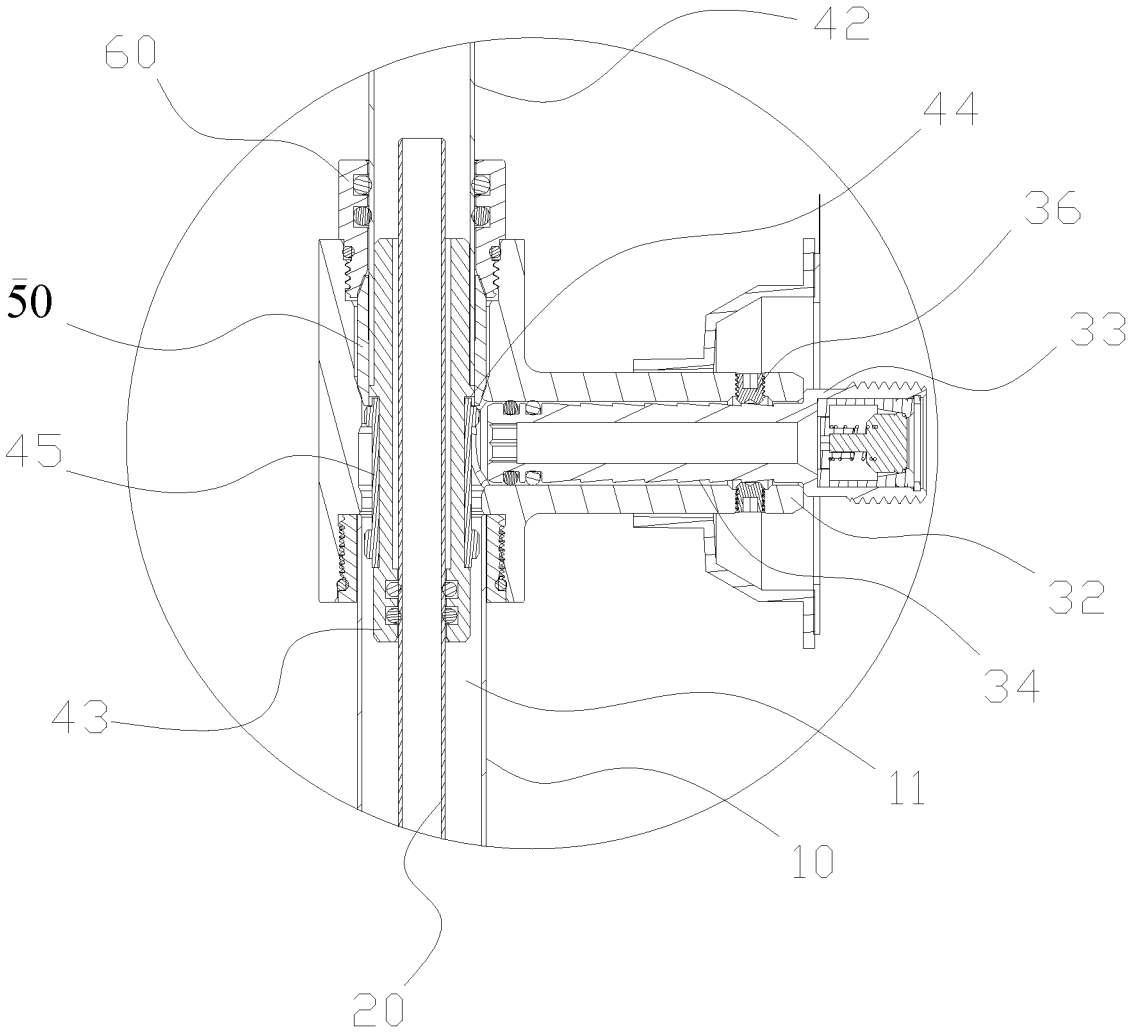
FIG. 4 is a schematic diagram of an enlarged portion A of a liftable and adjustable shower device shown in FIG. 3 according to the present invention.
Figure 5:
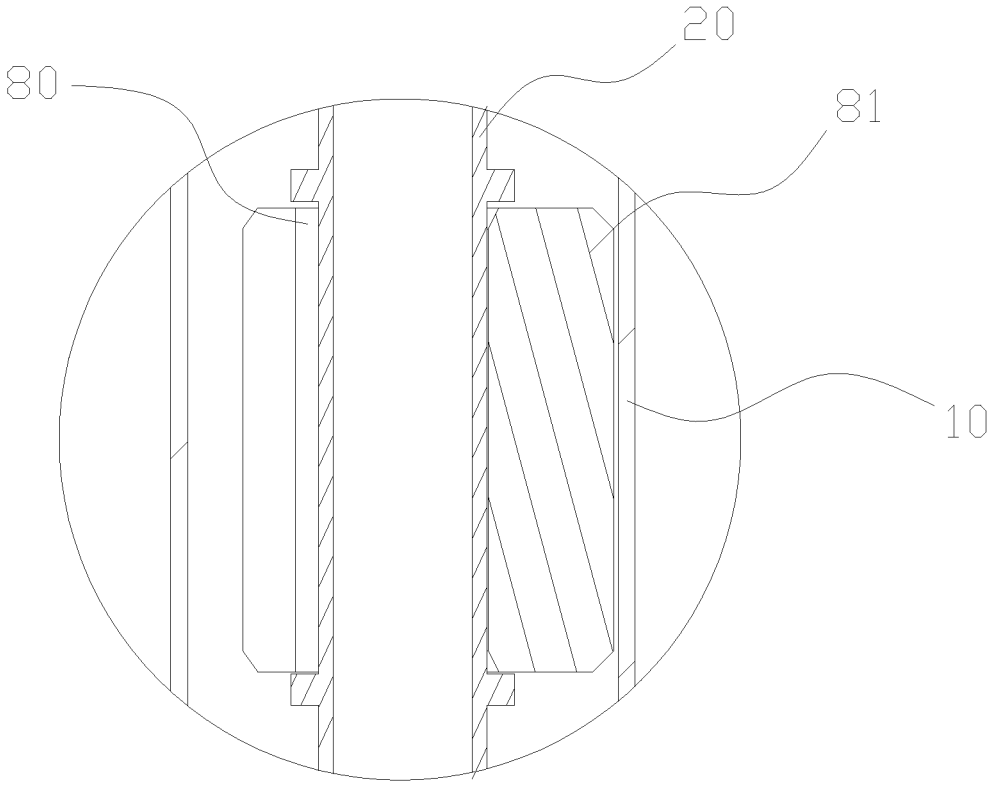
FIG. 5 is a schematic diagram of an enlarged portion B of a liftable and adjustable shower device shown in FIG. 3 according to the present invention.
Figure 6:
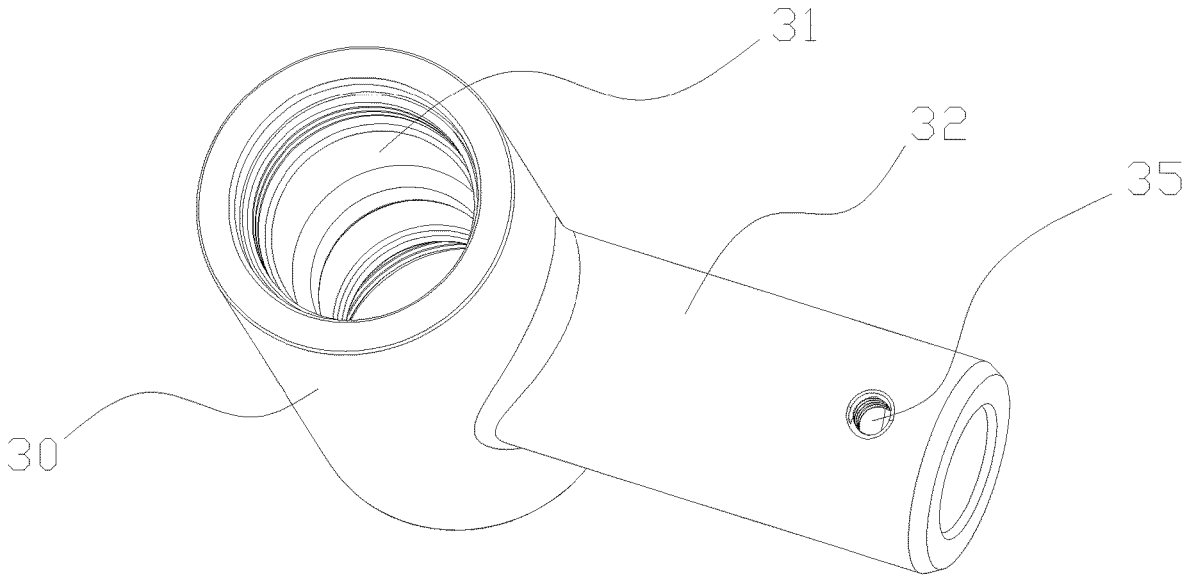
FIG. 6 is a schematic diagram of an upper fixing seat for a liftable and adjustable shower device according to the present invention.
Figure 7:
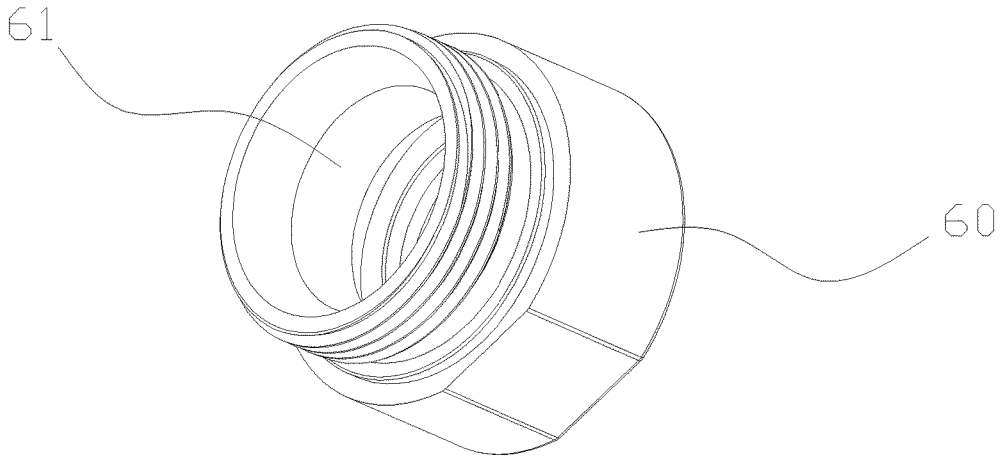
FIG. 7 is a schematic diagram of a press tight nut for a liftable and adjustable shower device according to the present invention.
Figure 8:
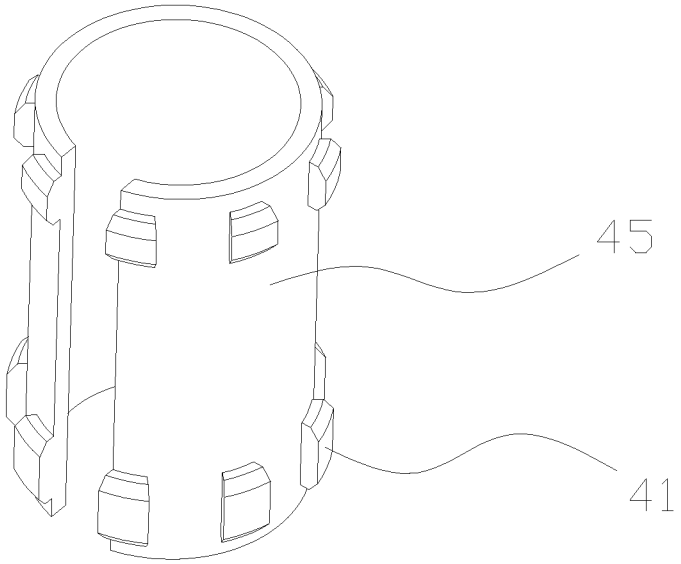
FIG. 8 is a schematic diagram of a fastening ring for a liftable and adjustable shower device according to the present invention.
Figure 9:
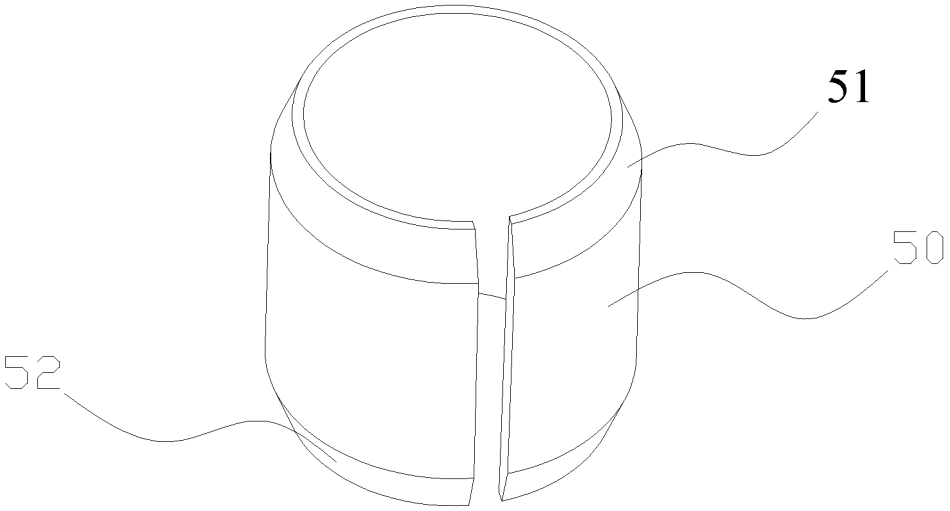
FIG. 9 is a schematic diagram of a connection ring for a liftable and adjustable shower device according to the present invention.

Refer to FIGS. 1 to 9 respectively for a schematic diagram of a liftable and adjustable shower device according to the present invention; a schematic diagram of a liftable and adjustable shower device in an adjusted condition according to the present invention; a schematic diagram of a liftable and adjustable shower device in another adjusted condition according to the present invention; a schematic diagram of an enlarged portion A of a liftable and adjustable shower device shown in FIG. 3 according to the present invention; a schematic diagram of an enlarged portion B of a liftable and adjustable shower device shown in FIG. 3 according to the present invention; a schematic diagram of an upper fixing seat for a liftable and adjustable shower device according to the present invention; a schematic diagram of a press tight nut for a liftable and adjustable shower device according to the present invention; a schematic diagram of a fastening ring for a liftable and adjustable shower device according to the present invention; and a schematic diagram of a connection ring for a liftable and adjustable shower device according to the present invention.

As shown in FIGS. 1 to 9, the present invention provides a liftable and adjustable shower device, that includes: an outer tube 10, an inner tube 20, an upper fixing seat 30, and a liftable tube 40. The outer tube 10 is disposed in the shower device; and the inner tube 20 is disposed in the outer tube 10. The upper fixing seat 30 is disposed around an upper end of the outer tube 10. The liftable tube 40 is sleeved around the inner tube 10, the liftable tube 40 is insertable from an upper end of the upper fixing seat 30, to sleeve around outside the outer tube 10. In the upper fixing seat 30 is disposed a connection ring 50 sleeving around an outer perimeter of the liftable tube 40. In the outer tube 10 and around an outer perimeter of the liftable tube 40 is disposed a stop block 41, acting in cooperation with a lower end of the connection ring 50.

A press tight nut 60 is disposed on the upper end of the upper fixing seat 30, acting in cooperation with the upper end of the upper fixing seat 30. A first slant face 61 is disposed at a lower end of the press tight nut 60, and the connection ring 50 is a C shape ring. At an upper end of the connection ring 50 is disposed a second slant face 51 acting in cooperation with the first slant face 61. In the upper fixing seat 30 is disposed a third slant face 31, and at a lower end of the connection ring 50 is disposed a fourth slant face 51 acting in cooperation with the third slant face 31. In operation, by screwing the press tight nut 60 downward, and through cooperation of the two sets of slant faces, the connection ring holds the liftable tube, to keep he liftable tube at a fixed height. The liftable tube 40 includes a bend tube 42 and a connector 43 located at a water inlet end of the bend tube 42. One end of the connector 43 can be inserted into the bend tube 42, while the other end of the connector 43 is disposed a ring shape slot 44. A fastening ring 45 is placed in and around the ring shape slot 44, and the stop block 41 is disposed at an outer perimeter of the fastening ring 45. At an upper end and a lower end and around the outer perimeter of the fastening ring 45 are disposed the stop blocks 41 forming into a ring shape. In a preferred embodiment of the present invention, a ring of stop blocks 41 are formed on an upper portion an on a lower portion of the fastening ring 45, and water passage channel is formed by the gaps between the stop blocks 41.

The water inlet tube 32 is disposed on the upper fixing seat 30, and a water inlet channel 11 is disposed between an inner perimeter of the outer tube 10 and an outer perimeter of the inner tube 20. The water inlet channel 11 is connected to the water inlet tube 32. A lower fixing seat 70 is disposed at a lower end of the outer tube 10. In the lower fixing seat 70 is disposed a switching valve 71 connected to and in communication with the water inlet channel 11. On the lower fixing seat 70 is disposed a water outlet tube 72 acting in cooperation with the switching valve 71, and the switching valve 71 is in contact with an inner perimeter of the inner tube 20. In other words, through switching of the switching valve, to decide if water flows into the water outlet tube and the inner tube. In operation, a Top Spray is disposed at the water outlet end of the bend tube, the water outlet tube is connected to a shower, and a shower seat is disposed on the outer tube to place and hold a shower head.

In the water inlet tube 32 is disposed a water inlet connector 33 in contact with the water inlet tube 32. At least two step faces 34 are disposed in the water inlet tube 32 and around an outer perimeter of the water inlet connector 33. A through hole 35 is disposed on a side wall of the water inlet tube 32. On the though hole 35 is disposed a lock tight screw 36 acting in cooperation with the at least two step faces 34, to suit the depth in the wall for different water inlet tubes.

A fixing ring 80 is fixed onto a wall around the outer perimeter of the inner tube 20, and a plurality of connection plates 81 are disposed on a wall around an outer perimeter of the fixing ring 80, to act in cooperation with a wall around the inner perimeter of the outer tube 10.

In the present invention, the diameter of the liftable tube is less than the outer tube, to ensure that the liftable tube can be inserted into the outer tube. The diameter of the inner tube is less than the liftable tube, to ensure that the inner tube can be inserted into the liftable tube. Tight seal piece (Oring or other tight seal piece) is adopted for tightly sealing the connector of the liftable tube and the press tight nut, and a fastening ring is used to guide the movement of the liftable tube along the outer tube. For the fastening ring, a stop block is provided, and water passage channel is formed between the stop blocks. The fastening ring is fastened at the connector of the liftable tube, while the water passage channel allows water to flow through. The stop block ensures that when the liftable tube is adjusted upward, the stop block is located below the end face of the connection ring, to restrict and fix position, to prevent the liftable tube from being popped out when it is moved upward. When the liftable tube is adjusted downward, the step face of the inner tube (that can be the fixing ring mentioned above) is used to restrict and fix the position of the liftable tube, to prevent the liftable tube from hitting the press tight nut to cause damages. The fixing ring is used for the inner tube, to ensure concentricity between the inner tube and the liftable tube, and the outer tube and the liftable tube, to facilitate upward and downward adjustment of the bend tube. As such, through cooperation of a slant face of the press tight nut and the slant face of the connection ring, and through cooperation of the slant face of the connection ring and the slant face of the upper fixing seat, such that when the press tight nut is locked tightly, the connection ring will hold the liftable tube to fix the position of the liftable tube.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A liftable and adjustable shower device, comprising:

an outer tube, disposed in the shower device;

an inner tube, disposed in the outer tube;

an upper fixing seat, disposed around an upper end of the outer tube; and a liftable tube sleeved around the inner tube, the liftable tube is insertable from an upper end of the upper fixing seat, to sleeve around outside the outer tube, wherein in the upper fixing seat is disposed a connection ring sleeving around an outer perimeter of the liftable tube, in the outer tube and around an outer perimeter of the liftable tube is disposed a stop block, acting in cooperation with a lower end of the connection ring; a press tight nut is disposed on the upper end of the upper fixing seat, acting in cooperation with the upper end of the upper fixing seat, a first slant face is disposed at a lower end of the press tight nut, the connection ring is a C shape ring, at an upper end of the connection ring is disposed a second slant face acting in cooperation with the first slant face, in the upper fixing seat is disposed a third slant face, and at a lower end of the connection ring is disposed a fourth slant face acting in cooperation with the third slant face.

2. The liftable and adjustable shower device as claimed in claim 1, wherein the liftable tube includes a bend tube and a connector located at a water inlet end of the bend tube, one end of the connector is insertable into the bend tube, the other end of the connector is disposed a ring shape slot, a fastening ring is placed in and around the ring shape slot, and the stop block is disposed at an outer perimeter of the fastening ring.

3. The liftable and adjustable shower device as claimed in claim 2, wherein on an upper end and a lower end and around the outer perimeter of the fastening ring are disposed the stop blocks forming into a ring.

4. The liftable and adjustable shower device as claimed in claim 3, wherein a water inlet tube is disposed on the upper fixing seat, and a water inlet channel is disposed between an inner perimeter of the outer tube and an outer perimeter of the inner tube, the water inlet channel is connected to the water inlet tube, a lower fixing seat is disposed at a lower end of the outer tube, in the lower fixing seat is disposed a switching valve connected to and in communication with the water inlet channel, on the lower fixing seat is disposed a water outlet tube acting in cooperation with the switching valve, and the switching valve is in contact with an inner perimeter of the inner tube.

5. The liftable and adjustable shower device as claimed in claim 4, wherein in the water inlet tube is disposed a water inlet connector in contact with the water inlet tube, at least two step faces are disposed in the water inlet tube and around an outer perimeter of the water inlet connector, a through hole is disposed on a side wall of the water inlet tube, and on the through hole is disposed a lock tight screw acting in cooperation with the at least two step faces.

6. The liftable and adjustable shower device as claimed in claim 5, wherein a fixing ring is fixed onto a wall around the outer perimeter of the inner tube, a plurality of connection plates are disposed on a wall around an outer perimeter of the fixing ring, to act in cooperation with a wall around the inner perimeter of the outer tube.

* * * * *